US009273499B2

(12) United States Patent
Stendal

(10) Patent No.: US 9,273,499 B2
(45) Date of Patent: Mar. 1, 2016

(54) LOCKING DEVICE COMPRISING ROTATING LINKS AND GUIDE WITH SLIDING ELEMENT

(75) Inventor: Jan Stendal, Vasteras (SE)

(73) Assignee: Stendals El AB, Vasteras (SE)

( * ) Notice: Subject to any disclaimer, the term of this patent is extended or adjusted under 35 U.S.C. 154(b) by 0 days.

(21) Appl. No.: 13/704,311

(22) PCT Filed: Jun. 17, 2011

(86) PCT No.: PCT/SE2011/050781

§ 371 (c)(1),
(2), (4) Date: Dec. 14, 2012

(87) PCT Pub. No.: WO2011/159249

PCT Pub. Date: Dec. 22, 2011

(65) Prior Publication Data

US 2013/0106120 A1 May 2, 2013

(30) Foreign Application Priority Data

Jun. 17, 2010 (SE) ..... 1050624

(51) Int. Cl.

| | |
|---|---|
| ***E05C 1/06*** | (2006.01) |
| ***E05C 1/08*** | (2006.01) |
| ***E05B 47/02*** | (2006.01) |
| *E05C 1/12* | (2006.01) |
| *E05B 63/20* | (2006.01) |

(Continued)

(52) U.S. Cl.

CPC ..... *E05C 1/08* (2013.01); *E05B 47/026* (2013.01); *E05B 17/2007* (2013.01); *E05B 47/0002* (2013.01); *E05B 2047/0093* (2013.01); *Y10T 292/1015* (2015.04)

(58) Field of Classification Search

CPC ..... Y10T 292/1015; Y10T 292/096; Y10T 292/0974

USPC ..... 292/36, 139, 138, 137, DIG. 36, 158, 292/167, 335, 332; 70/118, 119, 107–111

See application file for complete search history.

(56) References Cited

U.S. PATENT DOCUMENTS

| | | | | | |
|---|---|---|---|---|---|
| 768,418 | A | * | 8/1904 | Adams | 292/36 |
| 1,018,475 | A | * | 2/1912 | Bedell | 292/39 |
| 1,237,794 | A | * | 8/1917 | Liberman | 292/33 |

(Continued)

FOREIGN PATENT DOCUMENTS

| | | | |
|---|---|---|---|
| DE | 3218838 | C2 | 7/1986 |
| EP | 1721802 | A1 | 11/2006 |
| WO | 9508686 | A1 | 3/1995 |

OTHER PUBLICATIONS

International Search Report of International Application No. PCT/SE2011/050781 dated Sep. 29, 2011.

*Primary Examiner* — Kristina Fulton
*Assistant Examiner* — Faria Ahmad
(74) *Attorney, Agent, or Firm* — Norton Rose Fulbright US LLP

(57) ABSTRACT

The invention relates to a locking device for restricting or admitting access into an area or space, wherein the locking device comprises a locking mechanism arranged to move at least one locking element between a locked state, and an unlocked state, which locking mechanism is adapted to be connected with and to receive the motion for the movement from an operating mechanism arranged to control and to provide the motion for the movement.

14 Claims, 2 Drawing Sheets

Figure 1A:
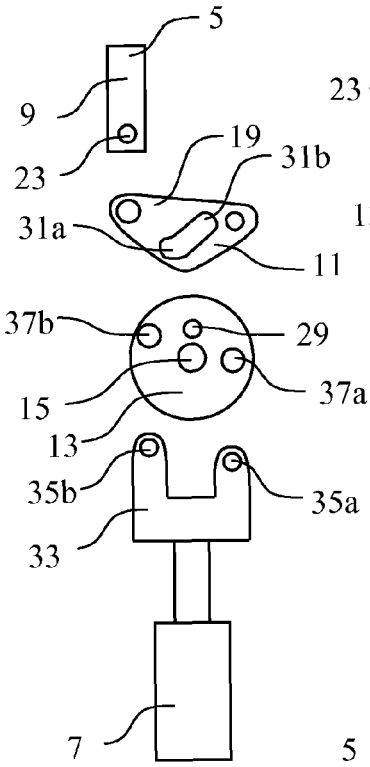

(51) Int. Cl.
*E05B 17/20* (2006.01)
*E05B 47/00* (2006.01)

(56) References Cited

U.S. PATENT DOCUMENTS

| | | | | | |
|---|---|---|---|---|---|
| 1,269,311 | A | * | 6/1918 | Rixson | 292/36 |
| 1,495,820 | A | * | 5/1924 | Tierney | 70/108 |
| 1,750,933 | A | * | 3/1930 | Koons, Sr. | 292/36 |
| 2,729,089 | A | * | 1/1956 | Pelcin | 70/151 R |
| 3,498,657 | A | * | 3/1970 | Fontana | 292/34 |
| 3,899,201 | A | * | 8/1975 | Paioletti | 292/25 |
| 3,953,061 | A | * | 4/1976 | Hansen et al. | 292/5 |
| 3,991,595 | A | * | 11/1976 | Bahry et al. | 70/120 |
| 4,130,306 | A | * | 12/1978 | Brkic | 292/5 |
| 4,147,044 | A | * | 4/1979 | Bernath | 70/119 |
| 4,154,070 | A | * | 5/1979 | Bahry et al. | 70/108 |
| 4,306,432 | A | * | 12/1981 | Ravid | 70/120 |
| 4,470,277 | A | * | 9/1984 | Uyeda | 70/118 |
| 4,665,727 | A | * | 5/1987 | Uyeda | 70/279.1 |
| 4,671,015 | A | * | 6/1987 | Curry et al. | 49/465 |
| 4,714,030 | A | * | 12/1987 | Cole | 109/61 |
| 5,077,992 | A | * | 1/1992 | Su | 70/107 |
| 5,341,752 | A | * | 8/1994 | Hambleton | 109/59 R |
| 5,382,060 | A | * | 1/1995 | O'Toole et al. | 292/46 |
| 5,437,484 | A | * | 8/1995 | Yamada | 292/36 |
| 5,472,246 | A | * | 12/1995 | Puric | 292/36 |
| 5,487,289 | A | * | 1/1996 | Otto et al. | 70/279.1 |
| 5,603,234 | A | * | 2/1997 | Lozier et al. | 70/119 |
| 5,697,234 | A | * | 12/1997 | Lozier et al. | 70/119 |
| 5,911,763 | A | * | 6/1999 | Quesada | 70/120 |
| 6,010,168 | A | * | 1/2000 | Johnson | 292/341.17 |
| 7,634,928 | B2 | * | 12/2009 | Hunt | 70/107 |
| 7,997,630 | B2 | * | 8/2011 | Lemley et al. | 292/36 |
| 8,382,166 | B2 | * | 2/2013 | Hagemeyer et al. | 292/161 |
| 8,479,543 | B2 | * | 7/2013 | Yang et al. | 70/118 |
| 2011/0193352 | A1 | * | 8/2011 | Huang et al. | 292/139 |
| 2013/0106120 | A1 | * | 5/2013 | Stendal | 292/139 |

* cited by examiner

LOCKING DEVICE COMPRISING ROTATING LINKS AND GUIDE WITH SLIDING ELEMENT

TECHNICAL FIELD

The present invention relates to a locking device suitable for restricting access into an area or space.

PRIOR ART

In order to protect property it is known to provide openable and closable closing elements for restricting access into an area or space. Such closing elements include doors, shutters, lids, grates, hatches, gates etc. The closing element is advantageously provided with a locking device comprising at least one locking element, such as a bolt, which, in a locked, extended state, bars the closing element from moving, and in an open, retracted state admits opening of the closing element, or a rotatable cam, which in a rotating, unlocked state, may allow passage of an extended locking bolt or similar, while in a non-rotating, locked state holds the locking bolt immovable. Such locking devices are usually mechanical, electromechanical or completely electrical, and may be actuated by a key, a key code, a key code signal or the like.

One problem with locking devices is that it may be possible to force the locking device open by applying a strong force onto the locking element, such as on the extended bolt, and pressing it towards its open state. This may be achieved by inserting a thin but strong element, such as a screwdriver, in a gap between the closing element and a jamb, and apply a force on the bolt or cam. Another problem is that it may be possible to move the bolt or cam stepwise towards the open position by providing a sequence of sharp blows to the locking device while applying a force on the bolt, a process known as knocking. Yet another problem is that it may be possible to insert a thin element, such as a flexible metal band, inside the locking device and move important parts of the locking mechanism to circumvent the need for a key.

In patent document U.S. Pat. No. 5,484,180, a locking device comprising a locking element in the form of a cam and intended to be arranged inside a door jamb is shown. The locking device comprises a hollow for receiving an extended locking bolt to lock the door, wherein the cam is arranged to, in a non-rotating state, hold the extended bolt in the hollow, and to, in a rotating state, allow the locking bolt to pass the rotating cam and out of the hollow. The cam is held in its non-rotating state by use of a hook, which in turn is movable by being connected to a rotating plate, the movement of which is controlled by a linear solenoid controlling a pin sliding in a slot formed in the rotating plate.

SUMMARY OF THE INVENTION

One objective of the present invention is to indicate a locking device having an improved locking function.

This objective is achieved with the locking device according to the preamble of claim 1, and which is characterized in the features stated in the characterizing part of the same claim.

According to one aspect of the invention such a locking device comprises a locking mechanism arranged to, in a first state, block at least one locking element from movement in a locked position of the locking element, and, in a second state, allow movement of the locking element to an unlocked position, which locking mechanism is adapted to be connected with and to receive the motion for changing the state of the locking mechanism from an operating mechanism arranged to control the state of the locking device. The locking device further comprises a blocking mechanism comprising a first link pivotably fixed relative to the locking device in a first pivot point and arranged to be connected with the operating mechanism in an operating mechanism connection point, a second link pivotably fixed in a second pivot point relative to the locking device and arranged to be connected with the bolt displacement mechanism in a locking mechanism connection point, and a connection arranged between the first and the second links comprising an elongated guide and a sliding element movable along said guide for restricting the motion of first and second links and to allow transfer of kinetic energy between the first and second links, and therefore between the operating mechanism and the locking mechanism.

By providing two rotatable links connected to each other in a connection comprising an elongated guide and an element slidable along the guide, the movement of the links becomes restricted, wherein a better control of the motion of the locking mechanism may be achieved. Preferably the elongated guide defines a path along which the slidable element moves during a rotation of the links, wherein the position in which the two links are connected to each other will change during a rotation. The connection is hence arranged to establish a guide for the mutual rotation of the links. The rotations of the links are thus coupled with each other, and are restricted and controlled by the shape of the connection, wherein the motion of the locking mechanism may be controlled to follow a desired motional pattern. Hence the functioning of the locking device may be improved, and also the chances for successfully tampering with the position or state of a locking element, such as a bolt, may be reduced, making the locking device more secure. Preferably, the blocking mechanism provides a knocking protection by restricting the movement of the locking mechanism in case the locking mechanism is subjected to tampering attempts.

According to one embodiment the locking mechanism comprises a blocking member arranged to block the at least one locking element from motion in the first state. The blocking member may be provided behind a locking element, such as behind a locking bolt for blocking movement of the locking bolt from an extended, locked state, to a retracted, unlocked state. The blocking member may also be provided in between a wall part of the locking device and a movable locking element, such as between a cam and a wall section, for blocking the cam from rotation. Preferably, the blocking member comprises a bevelled blocking surface adapted to make contact with and to block the locking element from movement. Such a bevelled blocking surface allows easier withdrawal of the blocking member in case the locking element is loaded. It is pivotal to combine such a bevelled surface with an adequate knocking protection as described above, in order for the lock to be secure.

According to another embodiment the locking mechanism is a bolt displacement mechanism arranged to move at least one locking bolt between an extended, locked position, and a withdrawn, open position, which bolt displacement mechanism is adapted to be connected with and to receive the motion for the displacement from an operating mechanism arranged to control and to provide the motion for the movement of the bolt. Thus the blocking mechanism is connected with the locking element and also arranged to provide the motion for moving the locking element between the unlocked and locked states of the locking element.

According to one embodiment the connection is arranged to allow a transfer of kinetic energy between the links, wherein movement of one link may result in a movement of the other link. The elongated guide and the slidable element are thus adapted to transfer forces between the links. In particular, the connection is adapted to allow a transfer of kinetic energy, or motion, from the first link to the second link, that is, in the direction from the operating mechanism to the locking mechanism, in order to forward motion to the blocking member and/or locking element. A force may be transferred by the slidable element pressing onto or being pressed towards a surface of the elongated guide. In particular, the connection may transfer motion from one link to the other link by the connection exerting a force originating from the motion of one link onto the other link, via the elongated guide and the sliding element. Furthermore, it is possible to achieve a desired length for the motion of the locking mechanism and/or a desired direction back or forth for the motion of the blocking member or the bolt, possibly depending on the length of the elongated guide, the extension or direction of the elongated guide, and depending on in which positions on the links other mechanical or electrical components are attached.

The elongated guide is preferably provided directly onto and/or inside one of the links and, correspondingly, the connecting element is preferably provided directly onto and/or inside the other link, so that the first and second links are directly attached to each other via the connection arrangement. In this context it should be appreciated that it is not vital for the invention which link is provided with the elongated guide and which link is provided with the slidable element. The links of the intermediary mechanism are preferably rigid and, due to the connection restricting the movement of the links, arranged to rotate only a part of a full circle. Preferably the links are arranged to co-move with each other and to transfer motion and/or a force between the links.

Preferably, the locking device is suitable for restricting access into an area or space in conjunction with a movable closing element. The area or space may be a building, a vehicle, a garden or any other premise or piece of furniture to which access should be restricted. Preferably the locking device comprises a locking bolt, wherein the bolt may admit or restrict movement and opening of the closing element. It is not strictly necessary that the locking device comprises the bolt per se, though it is an advantageous feature if it is incorporated into the locking device.

The operating mechanism may comprise both mechanical and electrical parts, and may receive an order from a user to operate the bolt, either in the form of mechanical action, such as by the turning of a key, or from an electrical signal, such as from a remote control opener or an electrical code lock.

According to one embodiment of the invention the first and second links are further shaped and connected with each other and/or with the operating mechanism and/or the locking mechanism so as to form a leverage between the operating mechanism and the locking mechanism. Hence it is possible to control the relative sizes of the forces involved and which acts on the operating mechanism and on the locking mechanism, respectively. Alternatively, it is possible to control the relative length of the motion for the operating mechanism relative to the length of the motion for the locking mechanism and thus the blocking member and/or locking element. Hence the locking device comprising a blocking mechanism according to the invention allows a better control of the design parameters of the locking device, and also simplifies the use of other types of mechanisms or components for the operating mechanism and/or the locking mechanism.

According to one embodiment at least a part of, preferably a major part of the connection between the first and second links is formed at a shorter radial distance from the second pivot point of the second link than the corresponding distance to the position of the connection between the second link and the locking mechanism. Preferably, the entire connection between the first and second links is formed at a shorter radial distance from the second pivot point of the second link than the corresponding distance to the position of the connection between the second link and the locking mechanism. When the second link rotates around the second pivot point the distance travelled by the connection between the first and second links is therefore shorter than the distance travelled by the connection between the second link and the locking mechanism. This results in an increased stroke for the locking mechanism, and thus possibly also to a blocking member or locking element, relative to the input motion, wherein the operating mechanism and the intermediary mechanism may move less, allowing a more compact design of the locking device.

According to one embodiment at least a part of, preferably at least a major part of the connection between the first and second links is formed at a shorter radial distance from the second pivot point of the second link than the corresponding distance to the position of the connection between the second link and the locking mechanism. Preferably, the entire connection between the first and second links is formed at a longer distance from the first pivot point of the first link than the corresponding distance to the position of the connection between the first link and the operating mechanism. When the first link rotates its connection with the second link travels a longer distance than its connection to the operating mechanism. Thus, the operating mechanism may be designed more compactly, since there is less need for movement within the operating mechanism, while keeping a long stroke for the connection between the first and second links.

Preferably, the locking device is designed comprising the combination of that the connection between the first and second links is formed at a shorter radial distance from the second pivot point of the second link than the corresponding distance to the position of the connection between the second link and the locking mechanism and that the connection between the first and second links being formed at a longer distance from the first pivot point of the first link than the corresponding distance to the position of the connection between the first link and the operating mechanism. Hence a two-step, inverted lever action is achieved, so that the parts of the locking mechanism, and thus possibly also a blocking member or locking element, may be moved a long distance by use of an operating mechanism comprising parts moving a much shorter distance.

According to one embodiment the blocking mechanism is shaped to block the locking mechanism from allowing a displacement of the locking element in response to an external force pressing the locking element in a direction from a locked state towards an unlocked state. Hence the blocking mechanism provides protection against knocking, and pressing of the bolt towards the locked position with brute force. This may be achieved by the elongated guide and the sliding element being shaped to block the locking mechanism from allowing a displacement of the locking element or blocking member in response to the external force pressing the locking element in the direction from a locked state towards an unlocked state. Thus the first and second links and the elongated guide and the sliding element are shaped to hold the links immovable in order to block the locking mechanism. Hence, a force applied onto the locking element will not give rise to a rotation of any of the links.

According to one other embodiment this can be achieved by the elongated guide and the sliding element comprises surfaces arranged to bear on each other when the locking element is in its locked state, wherein the surfaces are angled so that a force pressing the locking element towards an unlocked state results in a force pressing the sliding element towards a stop provided in the elongated guide. According to one embodiment the force pressing the locking element inwardly is transformed by the blocking mechanism into a force comprising one force component orthogonal to a local extension of the elongated guide, and one force component pressing the sliding element towards the stop. Thus the inability of the sliding element to move any further also obstructs the second link and the locking element from moving, so that the locking element cannot be forced open with less than breaking the blocking mechanism. Since the links may easily be reinforced to withstand high forces, the security of the device may thus be considerably improved. This also leads to a protection against knocking, since the slidable element can move in neither a stepwise, nor a continuous fashion.

According to one embodiment the links and the elongated guide are shaped such that the sliding element is positioned at one end of the elongated guide when the locking element is in its locked position, and such that the external force applied on the locking element for pressing the locking element inwardly is transformed into a resultant force acting to push the sliding element further against that end of the guide. Thus the sliding element will be unable to move any further blocking the movement of the locking element in the direction of unlocking the locking element. Repeatedly rapping the lock will likewise not move the locking element, since the movement is blocked by the sliding element in the guide.

According to another embodiment this can be achieved by the elongated guide being shaped to extend on both sides of the first pivot point of the first link, so that the first link is subjected to a force acting in different directions depending on the present location of the sliding element in the elongated guide, when an external force acting on the locking mechanism presses the locking element or blocking member in a direction from a locked state towards an unlocked state. Preferably the blocking mechanism and the elongated guide are shaped so that the sliding element is located on the side of the first pivot point in the elongated guide when the lock is locked such that the sliding element rotates the first link in the other direction than the opening direction. Hence, even though a force for pressing the locking element inwardly is applied the operating mechanism, through the change of direction achieved by the first link, is actually experiencing a force acting in the direction of locking the locking member.

According to yet another embodiment this may also be achieved by the blocking mechanism being adapted to transform the force pressing the locking element inwardly into a force acting onto one or more portions of the blocking mechanism, which portions are immovable or held immovable. The blocking mechanism (and hence the first and second links and the elongated guide and the sliding element) is thus shaped to transform the force applied onto the locking element for pressing the locking element inwardly into acting straight onto at least one of the fixed pivot points. Since the pivot points are located at fixed positions in the locking device and mostly admit a pivoting motion for each link, a force providing none or only a small torque component will be unable to move the link or links, even for high applied forces. Thus the chances of depressing the locking element by applying an external force are greatly limited. Thus the elongated guide and the sliding element are shaped and arranged relative to the links so as to restrict which forces acting between the links that will result in movement. Preferably, the principles for blocking the locking element or blocking member with the blocking mechanism shown above are combined into one and the same blocking mechanism, providing additional security.

According to one embodiment the elongated guide and the sliding element comprises surfaces arranged to bear on each other when the locking element is in its locked state, wherein the surfaces are angled so that an unlocking force from the operation mechanism and rotation of the first link results in a force having a force component urging the sliding element to slide along the elongated guide, and a second force component rotating the second link. Thus, the elongated guide and the sliding element are shaped to allow transferring motion originating from the operating mechanism from the first link to the second link for urging the locking element from its locked to its unlocked state. Hence, locking or unlocking of the locking element through use of the intended operating mechanism is allowed. However, the elongated guide and the sliding element are preferably designed so as to simultaneously avoid transferring a movement of the second link from the second link to the first link. The connection and the elongated guide with the sliding element are thus arranged to urge the first and second links to co-move with each other.

According to one embodiment the operating mechanism is arranged to act with a torque onto the first link in a direction of sliding the slidable element along the elongated guide. In particular, in case the locking element is in a locked state, and the sliding element is positioned towards a first end of the elongated guide, the operating mechanism is arranged to act with a torque onto the first link in a direction of sliding the slidable element along the elongated guide towards the other end of the elongated guide, wherein the locking element becomes unlocked. Hence, even though the slidable element is held immobile from forces originating from the locking element at one end of the elongated guide, it is still easy to open the lock without reverting to high forces by applying a torque in the correct direction with the operating mechanism.

According to one embodiment the elongated guide lies in the plane spanned by the rotation of the first link around the first pivot point. Preferably the second link is arranged to span the same plane when rotating around the second pivot point. Preferably the elongated guide is arranged to lie in a plane spanned by the rotation of both the first and second links around the first and second pivot points. Thus the connection between the links is simplified. The pivot points may comprise any form of design for attaching a link pivotably in the locking device.

According to one embodiment the elongated guide extends along a path arranged at an angle $>0°$ relative to a line through the second pivot point and the connection point between the second link and the locking mechanism. Preferably, the elongated guide extends along a path arranged at an angle $30°<a<75°$ relative to the line through the second pivot point and the connection point between the second link and the locking mechanism. Hence the direction of the elongated guide is suitable for achieving surfaces for transforming forces between the first and second links by the sliding element sliding along the elongated guide.

According to one embodiment the operating mechanism comprises an engagement member comprising first and second preformed engagement portions for engagement with the first link, which engagement portions are positioned on either side of the first pivot point. Thus the engagement member allows attachment to the first link on both sides of the first pivot point. Preferably, the first link correspondingly comprises first and second preformed attachment portions arranged on either side of the first pivot point for interaction with one of the engagement portions of the engagement member. Thus, the position of attachment between the engagement member and the first link may easily be changed, wherein the functioning of the locking device may be changed by changing on which side of the pivot point to make the attachment. In particular, the operating mechanism and the first link are thus arranged to allow a change between a failsafe and a fail-secure operation with same locking device by changing the side of attachment without changing the orientation or operation of any elements of the operating mechanism, the locking mechanism or of the blocking mechanism.

According to one embodiment the engagement member is designed to move with a linear motion, and the engagement portions and the attachment portions are preformed to allow a play in the sideway direction relative to the linear motion when forming the attachment. Thus rotation of the first link is simplified without the need to introduce further mechanical constructions or solutions.

According to one embodiment the operating mechanism comprises a solenoid and a linearly displaceable piston arranged therein for providing motion to the first link. Hence the locking device may be controlled remotely.

BRIEF DESCRIPTION OF THE ATTACHED DRAWINGS

The invention is now to be described as a number of non-limiting examples of the invention with reference to the attached drawings.

FIG. 1*a* shows an exploded view of a mechanism of a locking device according to one embodiment of the invention.

Figure 1B:
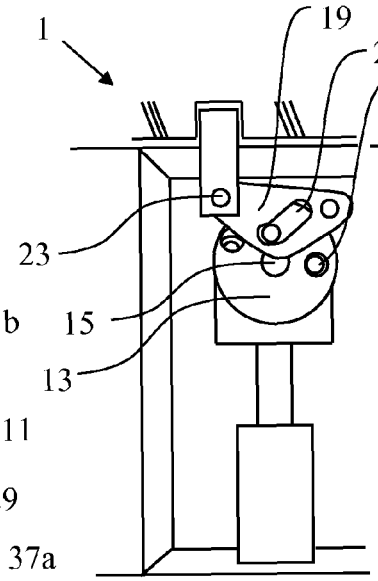
Figure 1C:
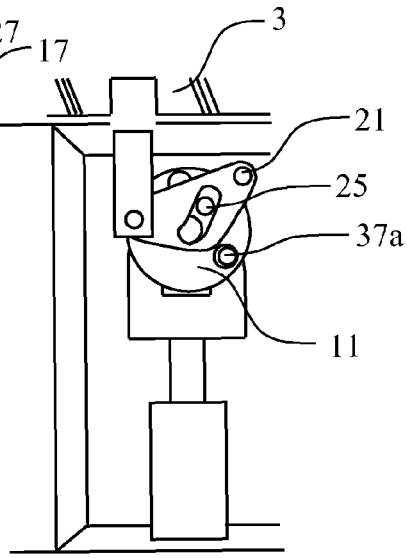

FIGS. 1*b-c* shows two states of a locking device according to the embodiment in FIG. 1*a* connected to operate in a first mode of operation.

Figure 1D:
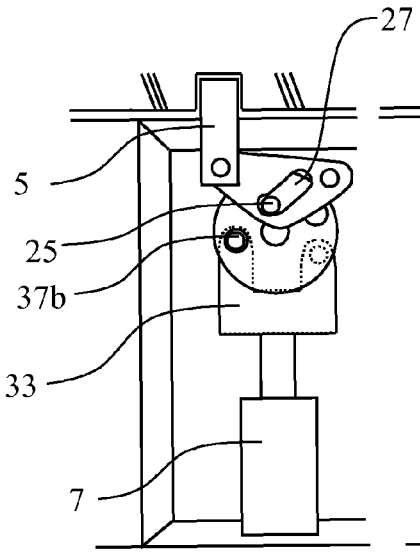
Figure 1E:
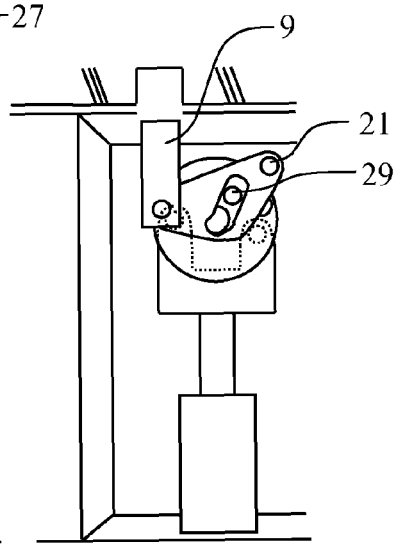

FIGS. 1*d-e* shows two states of a locking device according to the embodiment in FIG. 1*a* connected to operate in a second mode of operation.

Figure 2A:
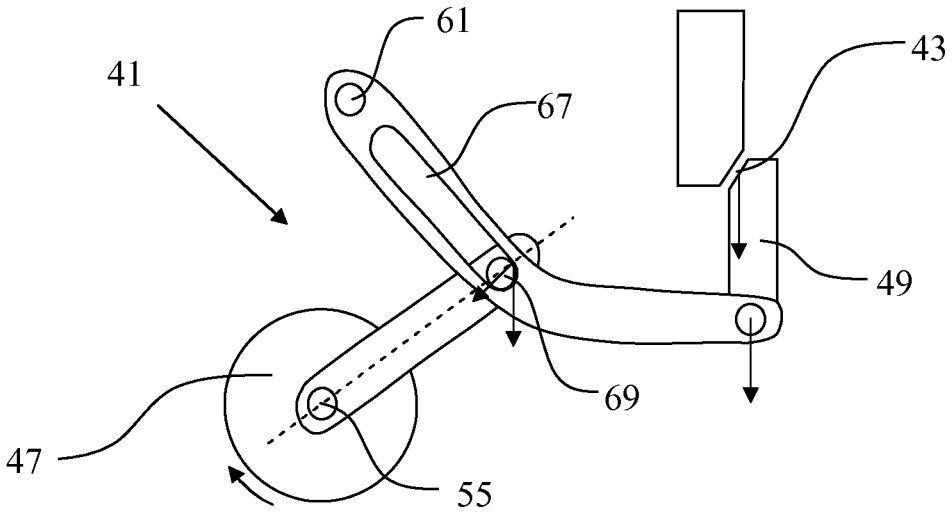
Figure 2B:
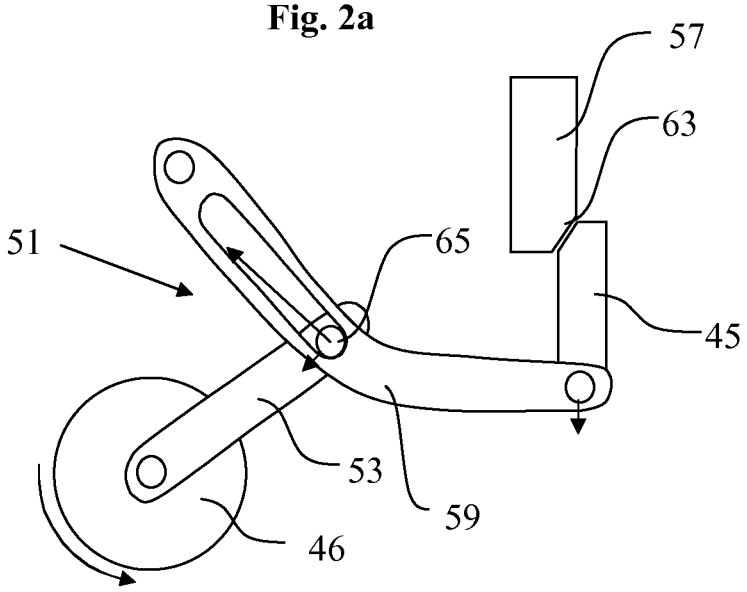

FIGS. 2*a-b* shows two different states of a second embodiment of a locking device mechanism according to the invention.

DETAILED DESCRIPTION

In FIGS. 1*a-e* a locking device 1 according to a first embodiment of the invention is shown. FIG. 1*a* shows an exploded view of the locking device, FIGS. 1*b-c* shows the locking device in a first mode of operation in two different states, and FIGS. 1*d-e* shows the locking device in a second mode of operation in two different states.

Generally, the locking device in FIGS. 1*a-e* is adapted to cooperate with a closing element 3 for restricting or admitting access into an area or space. The closing element 3 may be an element such as a door, a gate, a hatch, a lid, or any similar element arranged to cover an opening or entrance, and is therefore normally also shaped with a large area. The closing element 3 is arranged movable between a first, closed state, in which the closing element blocks the opening from admitting passage, and a second, open state, in which the closing element allows passage through the opening. The area or space may be a building, a vehicle, furniture, land, or any other form of premise or equipment.

In order to lock the closing element in its closed state the locking device comprises a locking element 5, in this example a dead bolt, arranged to hold the closing element in place. The bolt 5 is thus arranged to extend and form a connection between the closing element and an immovable object such as a jamb or similar in a first, locking state, as depicted in FIGS. 1*b* and 1*d* respectively. Alternatively it may extend across two closing elements moving in different directions, such as two gates, in order to hold them immovable. In a second unlocked state the bolt is retracted and disconnects the closing element from the immovable object, so that the closing element may move to its second, open state, as depicted in FIGS. 1*c* and 1*e*, respectively. In FIG. 1*b-e* the locking device is shown provided inserted inside the closing element, but the locking device could also be provided inside, or be attached onto, either of the closing element or the immovable object.

The locking device 1 comprises an operating mechanism 7 arranged to receive input from a user for operation of the locking mechanism. Such operating mechanisms 7 are known in the art and may be designed with great variety without departing from the scope of the invention. The operating mechanism 7 is therefore not described here to any length. For example, the operating mechanism may comprise, or may be connected with, a mechanical lock, such as a locking cylinder, an electronic lock, such as a card reader or remote controller, or any other form of lock operable by the user with a key, key code, key code signal or similar. The operating mechanism 7 may further be designed to either forward a mechanical action generated by the user, or to generate a mechanical action on its own in response to input from the user. The generated mechanical action is generated in order to provide motion for moving the bolt back and forth between its states. In this example the operating mechanism 7 comprises a solenoid comprising a plunger, wherein the solenoid is arranged to move the plunger in a mostly linear motion in response to signals from an electronic lock (not shown). The operating mechanism is thus arranged to receive open or closing commands from the user, and to generate motion for moving the bolt between its locked and unlocked states in response thereto.

The locking device 1 further comprises a locking mechanism 9, which is the lower part of the same element 5, in this example in the form of a bolt displacement mechanism, arranged to move the at least one locking bolt between its extended, locked position, and its withdrawn, open position. As with the operating mechanism 7 a wide variety of displacement mechanisms are known by a man skilled in the art, and most of these mechanisms may easily be adapted for use with the invention. The locking mechanism 9 is therefore not described to any length. For example, the bolt displacement mechanism may be adapted to be directly or, as in this example, indirectly connected with the operating mechanism, and to receive the motion for displacement of the locking bolt there from. In this example the bolt displacement mechanism 9 is simply depicted as the bolt itself connected with the moving parts of a blocking mechanism 11 as will be described below, but the displacement mechanism may in general comprise any number of mechanical members for moving the bolt and possibly also for performing other functions known within the art of locking devices. In one example, connecting elements for controlling other bolts depending on the state of the locking bolt, or guiding members for guiding the motion of the bolt to follow a desired path, or similar, may be provided.

According to this example of the invention the locking device further comprises a blocking mechanism 11 connected between the operating mechanism 7 and the locking mechanism 9. The blocking mechanism comprises a first link 13 which is pivotably fixed in a first pivot point 15 in the locking device. Thus the first link is held fixed against translational motion relative to the locking device in this point, while still being rotatable in relation to the locking device around the first pivot point 15. The first link is furthermore connected with the operating mechanism 7 in an operation mechanism connection point 17, and arranged to receive the mechanical action generated by the operating mechanism in the form of motion from the operating mechanism.

The blocking mechanism 11 also comprises a second link 19 pivotably fixed in a second pivot point 21 in the locking device. Thus the second link is held fixed against translational motion relative to the locking device in this second pivot point 21, while still being rotatable in relation to the locking device around the second pivot point 21. The second link 19 is further connected with the bolt displacement mechanism 9 in a locking mechanism connection point 23 and is arranged to further the motion from the operating mechanism 7 to the displacement mechanism 9 and then further to the bolt 5 in order to move the bolt between its first and second states.

The blocking mechanism 11 also comprises a connection 25 arranged between the first 13 and the second links 19. The connection comprises an elongated guide 27 associated with one of the links, in this example with the second link, and a sliding element 29 associated with the other link, in this example with the first link 13, and which is arranged to be movable along said guide 27. Hence the position in which the first 13 and second links 19 are connected with each other may move depending on the present location of the links. In this example the elongated guide 27 and the sliding element 29 are arranged to restrict the motion of the links relative to each other by interconnecting the links at different positions depending on their present angle. It should be appreciated that in another example the elongated guide could just as well be arranged on the first link while the sliding element could be arranged on the second link.

The elongated guide 27 and the sliding element 29 are arranged to allow a transfer of motion between the links, so that the motion of one link may be forwarded to the other link. In this example the elongated guide and the sliding element 29 are arranged to allow a transfer of motion from the first link to the second link, in order to allow transfer of the mechanical action generated by the operating mechanism to the bolt displacement mechanism for moving the bolt via the blocking mechanism 11 and the first and second links. Hence, by moving the first link the second link will be moved as well.

When moving the first link, the sliding element 29 is arranged to slide along the elongated guide, and thus to restrict the motion of the links relative to each other, at the same time as the connection 25 transfers said motion. Hence, the connection 25 between the links permits the links to rotate while simultaneously restricting their freedom of movement. By restricting the angle through which the links may rotate it is possible to achieve a nearly linear motion from rotation of the links, which in turn leads to that less space is needed for accommodating the locking mechanism. Another advantage is that it is possible to control the path and direction of the motion to follow a desired pattern. Thus, movement of one link implies movement of the other link, with a defined and controlled motion. Preferably the elongated guide 27 defines a path along which the sliding element 29 moves during a rotation of the links, wherein the position in which the two links are connected to each other will change during a rotation.

With the expression that the sliding element 29 is slidable along said guide is intended that the element may slide, but does not necessarily do so, depending on the present situation, and possibly also on any desired functions which the designer of the lock wishes to achieve. Inevitably, the sliding element will be affected by both frictional and normal forces, and preferably the design of the connection 25 is adapted such that an adequate and desired response is achieved for the motion of the sliding element relative to external influence and forces.

In this example the connection 25 between the first 13 and second links 19 is formed at a longer distance from the first pivot point 15 of the first link than the corresponding distance to the operating mechanism connection point 17 between the first link and the operating mechanism 7. Thus, due to leverage, when the operating mechanism 7 transfers motion to the first link via the operating mechanism connection point 17 the connection point with the second link will move a longer distance, meaning that the second link 19 will move a longer distance than the moving distance generated by the operating mechanism 7. In this example the connection point between the first and the second links will move longer than the distance travelled by the plunger. This is important since the solenoid may then be shorter making it easier to arrange within the locking device.

The connection 25 is further shaped such that the radial distance formed between the second pivot point 21 of the second link and the connection point between the first and second links is shorter than the corresponding radial distance formed between the second pivot point 21 and the bolt displacement connection point 23 between the second link and the bolt displacement mechanism 9. Hence a second leverage is achieved which further extends the motional distance of the locking bolt relative to the distance moved by the plunger of the operating mechanism.

In this example the elongated guide 27 comprises a slot formed in the second link. The slideable element 29 in turn comprises a rigid body in the form of a pin fixed on the first link 13, and arranged to slide along the slot. The elongated guide is arranged to run in an angle different from zero relative to a line passing through the second pivot point 21 and the locking mechanism connection point 23 with a first part of the elongated guide. In this example the elongated guide extends along a path arranged at an angle >0° relative to a line through the second pivot point 21 and the locking mechanism connection point 23, so as to allow movement of the sliding element 29 along a line formed by the slot. Hence the elongated guide 27 is arranged so as to allow a restricted motion when the first and second links are rotated. The motion is thus determined by both the length of the elongated guide, the angle of the elongated guide, and the positioning of the elongated guide. It should be appreciated that the elongated guide 27 and the sliding element 29 may be formed according to any known manner of forming a sliding connection, and should not necessarily be limited to the slot and rigid body shown in the present example.

The elongated guide 27 and the sliding element 29 are further shaped to allow a transfer of a force, and in some instances a transfer of a motion, from the first link to the second link. In this example the elongated guide and the sliding element 29 comprises surfaces arranged to bear on each other, wherein the surfaces are angled so that a force acting on the sliding element and the elongated guide results in a force having one force component urging the sliding element 29 to slide along the elongated guide 27, and a second force component rotating the first and second links. The force or motion may originate from the operating mechanism 7 in the direction of retracting the bolt from its locked, extended state, and/or in the direction of extending the bolt from its unlocked, withdrawn state. This is achieved by the sliding element being pressed towards the sides of the slots and thus transferring a force. In particular the elongated guide and the sliding element 29 comprises surfaces arranged to bear on each other when the bolt is in its locked, extended state, wherein the surfaces are angled so that an unlocking force from the operation mechanism, and which rotates the first link, results in a force having one force component urging the sliding element 29 to slide along the elongated guide 27, and a second force component rotating the first and second links. The elongated guide and the sliding element 29 are further shaped to block the locking mechanism from displacing the bolt in response to an external force pressing the bolt inwardly when the bolt is in its locked, extended state. This is achieved by combining several blocking principles, which are possible with the connection according to the invention.

One blocking principle comprises that the ends 31*a*-*b* of the elongated guide, in the form of the ends of the slot, are arranged to form stops for the motion of the sliding element in the elongated guide 27. Hence the length of the elongated guide also restricts the length of the motion for the first and second links. In this example the first end 31*a* of the elongated guide 27 is bent in a different angle such that a force originating from the locking mechanism in the direction of pressing the bolt inwardly is transformed into a force pressing the sliding element 29 further towards the stop rather than to slide back, in this case towards the end of the slot 31*a*. Since the sliding element 29 cannot go any further along the elongated guide the locking mechanism is blocked, so that it is virtually impossible to force the bolt inwardly by pressing onto the bolt.

Another blocking principle comprises that the elongated guide is shaped to extend on both sides of the first pivot point of the first link. Since the first link rotates around the first pivot point it will therefore experience a force acting to rotate the first link in different directions depending on which side of the elongated guide the sliding element is presently located. The elongated guide thus comprises at least one first side of the elongated guide shaped and positioned so that the sliding element rotates the first link in a direction other than an opening direction when an external force act on the locking mechanism to press the locking element in a direction from a locked state towards an unlocked state. In this example the first side is located closer to the connection point to the locking mechanism of the second link. However, when the force originates from the opening mechanism the elongated guide is angled so that the force is acting in the opposite direction even though the sliding element is in the first side, thus allowing the sliding element to slide along the elongated guide and rotate the first link in the opening direction. The two sides of the elongated guide relative to the first pivot point of the first link may be obtained by studying on which side of the first pivot a force acting on the first link will act.

Thus when an external force is acting on the locking element the blocking mechanism will transfer a force from the sliding element when the sliding element is located in the first side of the elongated guide, which force is therefore transferred to the first link to act in the direction opposite of the opening direction so that the locking element cannot be opened. Furthermore, the sliding element is pressed towards the first end 31*a* of the elongated guide, hindering further rotation of the first and second link and thus the combination effectively blocks the locking member from being pressed in.

Yet another blocking principle comprises that the blocking mechanism is adapted to transform the force pressing the locking element inwardly into a force acting onto one or more portions of the blocking mechanism, which portions are immovable or held immovable. In this example the blocking mechanism is shaped to transform the force applied onto the locking element for pressing the locking element inwardly into acting straight onto at least one of the fixed pivot points. In this example the sides of the elongated guide are angled so that the force from the sliding element is divided into a first force component pushing the sliding element further towards the stop, and a second force component acting to move the second first link which is directed towards the first pivot point. The first end 31*a* of the elongated guide 27 is further bent such that the force is directed straight onto the first pivot point 15, which is fixed from linear motion and therefore neutralizes the force, since the motion of the second link is restricted due to said connection 25. Since the first pivot point is fixed in the housing of the locking device it is held immovable, blocking the motion of the first link. Which principle is utilised in a particular situation may depend on tolerances, manufacturing variations and the present position of the sliding element.

The first link 13 is in this example formed by a plate in the shape of a circle. Naturally, the first link could be provided with any other geometric shape as well. The first link 13 is arranged such that the plane of the circular plate lies substantially in parallel with the plane of rotation of the first link around the first pivot point. The first pivot point 15 is arranged close to or in the center of the circular plate.

In this example the second link 19 comprises a plate having a substantially triangular shape, though with rounded corners. As with the first link the shape of the outer contour of the second link could also be formed in almost any other geometric shape as well, even though a triangular shape is preferred as will be apparent below. The second link 19 is connected with the second pivot point at a first corner of the triangle, and the bolt displacement mechanism connection point arranged at a second corner of the triangle. In this example the second link 19 comprises the elongated guide formed along the surface of the plate, wherein the elongated guide is arranged in the direction from about the middle of the base line between the first and second corners and the third corner of the triangle. By having a substantially triangular shape less material is thus needed for constructing the second link.

As with the first link, the plane spanned by the plate constituting the second link 19 is arranged in parallel with the plane of rotation of the second link. Furthermore, the first and second links are shaped so that their plane of rotations coincides. In this example the pivot points 15, 21 of the first and second links are thus arranged to allow rotation of the links in the same planes, but at a distance from each other. The pivot points are further fixed to the walls of the locking device. The elongated guide in the form of said slot is likewise arranged to lie in the plane spanned by the rotation of the first and second links around the first and second pivot points. Hence, the links and the elongated guide are shaped such that the sliding element moves along a curved path, and in the same plane, when the links are pivoted around their pivot points.

In this example the operating mechanism 7 comprises an engagement member 33 comprising first 35*a* and second preformed engagement portions 35*b* for engagement with the first link, which engagement portions are positioned on either side of the first pivot point 15. The first link correspondingly comprises first and second preformed attachment portions 37*a*, 37*b* arranged on either side of the first pivot point 15 for interaction with one of the engagement portions of the engagement member 33. By the first pivot point being located in a position in between the first and second engagement and attachment portions, the engagement member 33 and the first link 13 may be connected on either side of the first pivot point. In this example the engagement member comprises a forked or Y-shaped head, with arms comprising the engagement portions extending on either side of the first pivot point.

Since the attachment is made at a distance from the first pivot point the first link 13 will rotate while the engagement member 33 performs a linear motion. In this example the preformed attachment portions 37*a*, 37*b* comprises holes for allowing a fastening with for example a bolt, screw, or similar. One of either the attachment portions on the first link or the engagement portions on the engagement member are furthermore arranged with a larger diameter to allow a play in the sideway direction relative to the linear motion of the engagement member, in order to simplify the rotation of the first link without strain in the sideway direction.

In FIGS. 1*b-c* the engagement member 33 and the first link 13 are shown to be engaged in a first mode of engagement, with the engagement portions 35*a*, and attachment portions 37*a* on the right hand side of the first pivot point 15 being connected with each other. This leads to that the locking device 1 functions in a fail-safe mode, so that in the event of a power failure, in which case the plunger will retract, the locking bolt will also retract automatically, so that any individuals remaining inside the closed off area may get out. This is advantageous for example in case of fires, so that no one will be burnt to death, or in other types of catastrophes in which people must be allowed to exit.

In FIGS. 1*d-e* the engagement member 33 and the first link 13 are shown to be engaged in a second mode of engagement, with the engagement portions 35*b* and the attachment portions 37*b* on the left hand side of the first pivot point 15 being connected with each other. Thus, when retracting or extending the plunger of the operating mechanism the first link 13 will rotate in the other direction relative to the rotation direction of the device as shown in FIGS. 1*b-c*. This leads to that the locking device functions in a fail-secure mode, so that in the event of a power failure, in which case the plunger will retract, the locking bolt will remain extended and lock the closing element. This is advantageous for locks locking off areas in which no people normally stays, and for high security locks, such as for bank vaults.

Thus, by allowing that the engagement member 33 and the first link 13 to be connected on either side of the first pivot point 15 for the same locking device, the locking device may function in either fail-safe or fail-secure mode, by simply changing location of the engagement, for example with use of a screw or other fastener. Hence only one type of locking device is needed, which may decrease manufacturing costs, and also allow for a more versatile locking device.

In FIGS. 2*a-b* a second example of a locking device 41 comprising a operating mechanism connected with a locking mechanism according to the invention is shown. The locking device comprises an operating mechanism 47 connected with the locking mechanism, and comprising a rotatable, cylinder-shaped, control member 46. The control member 46 is in this example arranged to rotate in the clockwise direction for achieving a retraction of a blocking member 45 from blocking a locking element 57 such as a locking bolt or cam, and anti-clockwise for extending the blocking member 45 to block the locking element from moving. The control member may for example be a key actuated locking cylinder or a remote controlled electric motor.

The locking mechanism further comprises a blocking mechanism 51 comprising a first link 53 having a first pivot point 55 coinciding with the pivot point of, and being connected with, the cylinder 46. Hence rotation of the control member 46 of the operating mechanism 47 is directly transferred to the first link 53.

The blocking mechanism further comprises a second link 59, pivotably attached in the wall of the locking device in a second pivot point 61. The second link is provided with a connection 65 comprising an elongated guide 67 in the form of a slot, adapted to receive a sliding element 69 which is attached onto the first link and to allow the sliding element to slide in and along the slot. The second link is further attached to a locking mechanism 49 in a locking mechanism point 63, which locking mechanism is arranged to guide the displacement of the blocking member 45 between a first, non-blocking, unlocked state, and a second, blocking, locked state.

As with the example in FIGS. 1*a-e*, the elongated guide 67 is arranged to restrict and control the motion of the first 13 and second links 59 relative to each other. In this respect the links and the connection 65 between the links are shaped so that a force acting to depress an extended blocking member being in its blocking state is transferred by the inner surfaces of the slot acting onto the outer surfaces of the sliding element into a force forcing the sliding element further towards the end of the slot, which thus acts as a stop to block any further displacement of the blocking member.

In case the operating mechanism 47 rotates the first link however, the rotation will instead lead to that the sliding element is slid along the slot, and such that the force acting on the sliding element is transformed by said surfaces into a force having one force component for sliding the element along the slot, and another force component for rotating the second link, and hence also retracting the blocking member towards a non-blocking state.

The first 53 and second 59 links are further connected with each other and with the operating mechanism 47 and the displacement mechanism 49 so as to form a leverage, so that the distance of the rotation of the operating mechanism is less than the distance travelled by the blocking member. In this example the distance between the second pivot point 61 and the locking mechanism point 63 is longer than the distance between the second pivot point and the connection between the first and second links, giving the desired leverage.

In another embodiment however, the locking mechanism may be designed so that the leverage instead acts in the other direction. Thus the force retracting or extending the blocking member is higher than the force generated by the operating mechanism. This is advantageous in case the blocking member is very large or heavy, such as in high security locks. In this embodiment the distance for example between the second pivot point and the locking mechanism point should be smaller than the distance between the second pivot point and the connection between the first and second links.

The blocking member 45 is further provided with a bevelled surface 43 arranged to bear against and block the movement of the locking element 57. The locking element is correspondingly provided with a bevelled surface 63 adapted to bear against the blocking member 45. Hence, in case the locking element 57 is loaded by an external force, the increase in friction, which could otherwise cause the blocking member 45 to become stuck, is less prominent so that the blocking element may more easily be withdrawn. The provision of the blocking mechanism 51 then ensures that the externally applied force is unable to press the blocking member to its non-blocking position.

The invention is not limited to the embodiments and examples described but may be varied freely within the framework of the following claims. In particular, a locking device may comprise additional mechanical constructions and mechanisms apart from the locking, blocking, and operating mechanisms disclosed herein without departing from the scope of the invention. Furthermore, the locking device in FIGS. 1*a-e* my be arranged to control a blocking member instead of a locking bolt, and similarly, the locking device in FIG. 2 may be arranged to control a locking bolt instead of a blocking member.

The invention claimed is:

1. A locking device for restricting or admitting access into an area or space, wherein the locking device comprises a locking mechanism arranged to, in a first state, lock at least one locking element from movement in a locked position of the locking element, and, in a second state, allow movement of the locking element to an unlocked position, which locking mechanism is adapted to be connected with and to receive the motion for changing the state of the locking mechanism from an operating mechanism arranged to control the state of the locking device, wherein the locking device comprises a blocking mechanism connected between the locking mechanism and the operating mechanism to allow transfer of kinetic energy between the operating mechanism and the locking mechanism, the blocking mechanism comprising a first link pivotably fixed relative to the locking device in a first pivot point and connected with the operating mechanism in an operating mechanism connection point, a second link pivotably fixed relative to the locking device in a second pivot point and connected with the locking mechanism in a locking mechanism connection point, wherein the first and second pivot points are fixed to walls of the locking device, and a connection arranged between the first and the second links comprising an elongated guide and a sliding element movable along said guide for restricting the motion of first and second links and to allow transfer of kinetic energy between the first and second links, wherein the elongated guide and the sliding element are configured to block the locking mechanism from allowing a displacement of the locking element in response to an external force pressing the locking element in a direction from a locked state towards an unlocked state by the elongated guide and the sliding element comprising surfaces bear on each other when the locking element is in its locked state, wherein the surfaces are angled so that the external force pressing the locking element towards an unlocked state results in a force pressing the sliding element towards a stop provided in the elongated guide;

wherein the locking device is configurable in a first mode and a second mode;

wherein the first mode comprises a first-side engagement portion of an engagement member coupled to a first-side attachment portion on the first link; and wherein the second mode comprises a second-side engagement portion of the engagement member coupled to a second-side attachment portion on the first link;

wherein said first mode is a fail-safe mode and is configured such that when the engagement member retracts, the locking element retracts into an unlocked state; and wherein said second mode is a fail-secure mode and is configured such that when the engagement member retracts, the locking element extends into a locked state.

2. A locking device according to claim 1, wherein the connection arranged between the first and the second links is arranged to allow a transfer of kinetic energy between the links, wherein the first and second links are configured with each other and/or with the operating mechanism and/or the locking mechanism so as to form a leverage between the operating mechanism and the locking mechanism.

3. A locking device according to claim 2, wherein said connection between the first and second links is formed at a shorter radial distance from the second pivot point of the second link than the corresponding distance to the connection between the second link and the locking mechanism.

4. A locking device according to claim 2, wherein said connection between the first and second links is formed at a longer distance from the first pivot point of the first link than the corresponding distance to the connection between the first link and the operating mechanism.

5. A locking device according to claim 1, wherein the elongated guide is shaped to extend on both sides of the first pivot point of the first link, so that the first link is rotated in different directions when subjected to a force acting via the elongated guide depending on the present location of the sliding element in the elongated guide.

6. A locking device according to claim 1, wherein the elongated guide and the sliding element are configured to transfer motion originating from the operating mechanism from the first link to the second link for moving the locking mechanism towards an unlocked state.

7. A locking device according to claim 6, wherein the elongated guide and the sliding element comprises surfaces that bear on each other when the locking element is blocked, wherein the surfaces are angled so that an unlocking force from the operation mechanism and rotating the first link results in a force having a force component urging the sliding element to slide along the elongated guide, and a second force component rotating the second link.

8. A locking device according to claim 1, wherein the elongated guide is arranged to lie in a plane spanned by the rotation of the first and second links around the first and second pivot points.

9. A locking device according to claim 8, wherein the elongated guide extends along a path arranged at an angle >0° relative to a line through the second pivot point and the connection point between the second link and the locking mechanism.

10. A locking device according to claim 1, wherein the operating mechanism comprises an engagement member comprising first and second preformed engagement portions for engagement with the first link, which engagement portions are positioned on either side of the first pivot point.

11. A locking device according to claim 10, wherein the first link correspondingly comprises first and second preformed attachment portions arranged on either side of the first pivot point for receipt of one of the engagement portions of the engagement member.

12. A locking device according to claim 11, wherein the engagement member is designed to move with a linear motion, wherein the engagement portions and the attachment portions are preformed to allow a clearance in the sideway direction relative to the linear motion.

13. A locking device according to claim 1, wherein the locking mechanism comprises a blocking member comprising a bevelled blocking surface which, in the first state, blocks the at least one locking element from motion.

14. A locking device according to claim 1, wherein the locking mechanism is a bolt displacement mechanism arranged to move at least one locking bolt between an extended, locked position, and a withdrawn, open position, which bolt displacement mechanism is adapted to be connected with and to receive the motion for the displacement from an operating mechanism arranged to control and to provide the motion for the movement of the bolt.

* * * * *